US009725193B2

(12) United States Patent
Friedlein

(10) Patent No.: US 9,725,193 B2
(45) Date of Patent: Aug. 8, 2017

(54) CONTAINER FILLING SYSTEMS AND METHODS

(71) Applicant: The Coca-Cola Company, Atlanta, GA (US)

(72) Inventor: Mark F. Friedlein, Peachtree City, GA (US)

(73) Assignee: The Coca-Cola Company, Atlanta, GA (US)

( * ) Notice: Subject to any disclaimer, the term of this patent is extended or adjusted under 35 U.S.C. 154(b) by 53 days.

(21) Appl. No.: 14/739,021

(22) Filed: Jun. 15, 2015

(65) Prior Publication Data

US 2015/0298830 A1 Oct. 22, 2015

Related U.S. Application Data

(62) Division of application No. 13/648,327, filed on Oct. 10, 2012, now Pat. No. 9,090,362, and a division of application No. 12/494,427, filed on Jun. 30, 2009, now Pat. No. 8,333,224.

(51) Int. Cl.

| | |
|---|---|
| ***B65B 3/04*** | (2006.01) |
| ***B65B 3/02*** | (2006.01) |
| ***B65B 43/54*** | (2006.01) |

(52) U.S. Cl.

CPC ..... *B65B 3/045* (2013.01); *B65B 3/02* (2013.01); *B65B 43/54* (2013.01); *B65B 2220/18* (2013.01); *B65B 2230/02* (2013.01)

(58) Field of Classification Search

CPC ..... B65B 3/045; B65B 3/54; B65B 43/56
USPC ..... 141/10, 101–105, 114, 164, 168, 171, 141/315, 316; 53/572; 198/373, 379
See application file for complete search history.

(56) References Cited

U.S. PATENT DOCUMENTS

| | | | | |
|---|---|---|---|---|
| 858,051 | A | 6/1907 | Allen | |
| 2,507,269 | A | 5/1950 | Quayle | |
| 2,524,908 | A | 10/1950 | Hartman et al. | |
| 2,532,604 | A | 12/1950 | Carski | |
| 2,548,222 | A * | 4/1951 | Kindseth | B65B 1/22 141/103 |
| 2,732,989 | A * | 1/1956 | Harker | B65B 29/10 141/103 |
| 2,768,655 | A | 10/1956 | Bergeron | |

(Continued)

FOREIGN PATENT DOCUMENTS

| | | | |
|---|---|---|---|
| DE | 1761110 | A1 | 4/1971 |
| DE | 3809347 | A1 | 10/1989 |

(Continued)

OTHER PUBLICATIONS

Inoue & Associates—JP Office Action for JP App No. 2015-084609, dated Apr. 6, 2016.

(Continued)

*Primary Examiner* — Timothy L Maust
(74) *Attorney, Agent, or Firm* — Eversheds Sutherland (US) LLP

(57) ABSTRACT

A method of filling a cartridge having one or more pouches. The method may include the steps of placing the pouch on a support, placing a first cartridge half over the pouch and the support, placing the pouch and the first cartridge half on a second cartridge half to form the cartridge, maneuvering the cartridge to a filling unit, and filling the pouch within the cartridge.

20 Claims, 15 Drawing Sheets

(56) References Cited

U.S. PATENT DOCUMENTS

| | | | | |
|---|---|---|---|---|
| 3,020,939 | A | 2/1962 | Donofrio | |
| 3,250,373 | A | 5/1966 | Alexander | |
| 3,785,410 | A | 1/1974 | Carter | |
| 4,089,255 | A | 5/1978 | Akoh et al. | |
| 4,128,116 | A | 12/1978 | Uthoff et al. | |
| 4,325,418 | A * | 4/1982 | Henle | B65B 39/12 141/103 |
| 4,326,568 | A | 4/1982 | Burton et al. | |
| 4,411,295 | A | 10/1983 | Nutter | |
| 4,512,377 | A | 4/1985 | Greer | |
| 4,901,504 | A | 2/1990 | Tsuji et al. | |
| 4,959,947 | A * | 10/1990 | Reif | B65B 1/32 141/103 |
| 4,969,915 | A | 11/1990 | Hatanaka et al. | |
| 5,095,960 | A | 3/1992 | Grundler et al. | |
| 5,129,212 | A * | 7/1992 | Duffey | B65B 55/022 141/10 |
| 5,357,733 | A * | 10/1994 | Weikert | B65B 3/04 141/10 |
| 5,428,938 | A | 7/1995 | Davis | |
| 5,522,438 | A | 6/1996 | Gustafsson et al. | |
| 5,701,937 | A | 12/1997 | Bourboulou et al. | |
| 5,713,403 | A | 2/1998 | Clusserath et al. | |
| 5,944,073 | A | 8/1999 | Klein | |
| 6,044,876 | A | 4/2000 | Ally et al. | |
| 6,176,369 | B1 * | 1/2001 | Petrovic | B65G 17/002 198/803.14 |
| 6,199,601 | B1 * | 3/2001 | Laudenberg | B65B 31/041 141/114 |
| 6,209,708 | B1 | 4/2001 | Phillip et al. | |
| 6,286,568 | B1 | 9/2001 | Araki et al. | |
| 6,419,076 | B1 | 7/2002 | Tsutsui | |
| 6,522,945 | B2 | 2/2003 | Sleep et al. | |
| 6,575,289 | B2 | 6/2003 | Hiramoto et al. | |
| 6,644,462 | B2 | 11/2003 | Hiramoto et al. | |
| 6,719,015 | B2 | 4/2004 | Murray | |
| 6,799,674 | B2 | 10/2004 | Hiramoto et al. | |
| 6,827,113 | B2 | 12/2004 | Downs et al. | |
| 6,931,824 | B2 | 8/2005 | Rogers | |
| 7,032,363 | B1 | 4/2006 | Annehed et al. | |
| 7,100,643 | B1 | 9/2006 | Klima, Jr. et al. | |
| 7,104,390 | B2 | 9/2006 | Hiramoto et al. | |
| 7,299,606 | B2 | 11/2007 | Bonatti et al. | |
| 7,313,898 | B1 | 1/2008 | Eller et al. | |
| 7,584,593 | B2 * | 9/2009 | Murray | B65B 43/30 493/309 |
| 7,611,102 | B2 | 11/2009 | Murray | |
| 7,673,438 | B2 | 3/2010 | Murray | |
| 8,366,855 | B2 * | 2/2013 | Murray | B29C 66/83221 156/249 |
| 2002/0038756 | A1 | 4/2002 | Hiramoto et al. | |
| 2003/0173186 | A1 | 9/2003 | Hiramoto et al. | |
| 2003/0201280 | A1 | 10/2003 | Geshay | |
| 2004/0011626 | A1 | 1/2004 | Hiramoto et al. | |
| 2005/0109796 | A1 | 5/2005 | Bourque et al. | |
| 2005/0242122 | A1 | 11/2005 | Dyer | |
| 2006/0196784 | A1 * | 9/2006 | Murray | B65B 43/465 206/219 |
| 2007/0205221 | A1 | 9/2007 | Carpenter et al. | |
| 2008/0041018 | A1 | 2/2008 | Stephenson | |
| 2008/0072547 | A1 | 3/2008 | Murray | |
| 2008/0072548 | A1 | 3/2008 | Guttinger et al. | |
| 2008/0271809 | A1 | 11/2008 | Goldman et al. | |
| 2015/0059288 | A1 * | 3/2015 | Wu | B65B 55/027 53/426 |

FOREIGN PATENT DOCUMENTS

| | | | |
|---|---|---|---|
| EP | 0615909 | A1 | 9/1994 |
| EP | 1283172 | A1 | 2/2003 |
| JP | 2-298226 | | 10/1994 |
| JP | 2003-175997 | A | 6/2003 |
| JP | 2004-262464 | A | 9/2004 |
| JP | 2005-298024 | A | 10/2005 |

OTHER PUBLICATIONS

Seiko Corp., Title: Machine generated translation of JP 2003-175997-A, entitled "A Liquid Filling Apparatus", downloaded from JPO's website, pp. 1-17.

* cited by examiner

CONTAINER FILLING SYSTEMS AND METHODS

RELATED APPLICATIONS

The present application is a divisional of U.S. Ser. No. 13/648,327, filed on Oct. 10, 2012, entitled "Container Filling Systems and Methods", now allowed, which is a divisional of U.S. Pat. No. 8,333,224, filed on Jun. 30, 2009, entitled "Container Filling Systems and Methods." U.S. patent application Ser. No. 12/494,427 and U.S. Pat. No. 8,333,224 are incorporated by referenced herein in full.

TECHNICAL FIELD

The present application relates generally to container filling systems and methods and more particularly relates to systems and methods for the manufacture, assembly, transport, and filling of the several component used to create a container and the like.

BACKGROUND OF THE INVENTION

Beverage dispensers traditionally combined a diluent (such as water) with a beverage base. The beverage bases generally have a reconstitution ratio of about three to one (3:1) to about six to one (6:1). The beverage bases generally come in large containers that require a large amount of storage space. The beverage bases also may need to be refrigerated. These requirements often necessitate the need to store these containers far from the actual dispenser and to run long lines from the containers to the dispenser. Alternatively, the containers may be positioned near the dispenser but the size of the containers may limit the number of different beverage bases that may be used with the dispenser.

Several efforts have been made to limit the size of the containers used for beverage bases. For example, commonly owned U.S. Pat. No. 4,753,370 concerns a "Tri-Mix Sugar-Based Dispensing System." This patent describes a beverage dispensing system that separates the highly concentrated flavoring in the beverage base from the sweetener and the diluent. The separation allows for the creation of numerous beverage options using several flavor modules and one universal sweetener. U.S. Pat. No. 4,753,370 is incorporated herein by reference in full.

These separation techniques have continued to be refined and improved. For example, commonly owned U.S. Patent Publication No. 2007/0212468, entitled "Methods and Apparatuses for Making Compositions Comprising an Acid and an Acid Degradable Component and/or Compositions Comprising a Plurality of Selectable Components" describes separating the acid and the non-acid components of a non-sweetened concentrate and storing these components separately. This separation of the components allows for prolonged shelf life and also enables further concentration of the flavor components. U.S. Patent Publication No. 2007/0212468 is incorporated herein by reference in full.

Through the separation of the acid and the non-acid components and the further concentration of other beverage components into micro-ingredients, even more brands and flavors may be provided at the beverage dispenser. For example, U.S. Patent Publication No. 2007/0205221, entitled "Beverage Dispensing System", shows a beverage dispenser using multiple micro-ingredients, i.e., ingredients with reconstitution ratios of about ten to one (10:1) or higher. U.S. Patent Publication No. 2007/0205221 is incorporated herein by reference in full. Similarly, U.S. Patent Publication No. 2007/0205220, entitled "Juice Dispensing System", shows a juice dispenser using the micro-ingredients. U.S. Patent Publication No. 2007/0205220 is incorporated herein by reference in full.

In a somewhat similar manner, beverage bottles and cans are generally filled with a beverage in a container filling line via a batch process. The beverage components may be mixed in a blending area and then carbonated if desired. The finished beverage is then pumped to a filler bowl. The bottles and cans then may be filled with the finished beverage via a filler valve as the bottles and cans advanced along the filling line conveyor. The bottles and cans then may be capped, labeled, packaged, and transported to the consumer.

Commonly owned U.S. Patent Publication No. 2008/0271809, entitled "Multiple Stream Filling System", shows the application of the use of micro-ingredients to a filling line. Multiple micro-ingredient sources may be positioned along a filling line such that many different types of products may be produced along a continuously moving conveyor without filling line down time. U.S. Patent Publication No. 2008/0271809 is incorporated herein by reference in full.

Given the increased use of the micro-ingredients and similar components, there is a desire for an efficient system for filling the micro-ingredients in containers such that the container may be used by beverage dispensers and/or filling lines as desired. The systems and methods for filling the micro-ingredient containers preferably can assemble and fill the containers in a fast and automated manner.

SUMMARY OF THE INVENTION

The present application thus provides a method of filling a cartridge having one or more pouches. The method may include the steps of placing the pouch on a support, placing a first cartridge half over the pouch and the support, placing the pouch and the first cartridge half on a second cartridge half to form the cartridge, maneuvering the cartridge to a filling unit, and filling the pouch within the cartridge.

The method further may include the steps of hanging the pouch by a fitment and transporting the pouch. The step of placing the pouch on a support may include hanging the pouch within a pouch support via a fitment. The step of placing the first cartridge half over the pouch and the support may include attaching the first cartridge half to fitment. The method further may include the step of placing the second cartridge half within a bottom cartridge support of a pouch and cartridge pallet. The method further may include the step of heat staking the first cartridge half and the second cartridge half. The step of maneuvering the cartridge may include loading the cartridge within a puck. The step of filling the pouch within the cartridge may include positioning a filling nozzle within a fitment of the pouch. The cartridge may include two pouches therein and the step of filling the pouch within the cartridge may include filling a first pouch and then filling a second pouch.

The present application further describes a method of filling containers with either one or two pouches therein. The method may include the steps of loading the cartridges in a puck, maneuvering the puck to a first filling station, filling a first pouch within each cartridge having two pouches or filling the pouch in a first number of cartridges having one pouch at the first filling station, maneuvering the puck to a second filling station, and filling a second pouch within each cartridge having two pouches or filling the pouch in a second number of cartridges having one pouch at the second filling station.

The pouch filling steps may include positioning a filling nozzle within a fitment of each pouch. The positioning step may include maneuvering a filling nozzle via a cam. The method further may include the step of cleaning the cartridges. The step of loading the cartridges in a puck may include rotating the puck in a horizontal orientation and pushing the cartridges into the puck.

The present application further describes a cartridge filling system. The system may include means for transporting a number of pouches, means for transporting a number of cartridge halves, means for positioning a first cartridge half on a pouch, means for positioning the first cartridge half and the pouch on a second cartridge half to form a cartridge, means for transporting the cartridge, and means for filling the cartridge.

The present application further describes a container filling system. The container filling system may include a pouch transport system, a pouch and cartridge pallet, a pouch transfer assembly to position a pouch from the pouch transport system on the pouch and cartridge pallet, a cartridge takeoff device to position a first cartridge half on the pouch and a second cartridge half on the pouch and cartridge pallet, a cartridge assembly device to place the first cartridge half with the pouch on the second cartridge half, and a cartridge filling unit to fill the pouch of the cartridge with a liquid.

The container filling system further may include a puck loading station to load a number of cartridges in a puck. The cartridge filling unit may include a number of filling nozzles. The number of nozzles may include a cam for movement therewith. The container filling system further may include a cartridge picking assembly that cooperates with the cartridge takeoff assembly.

These and other features of the present application will become apparent to one of ordinary skill in the art upon review of the following detailed description when taken in conjunction with the several drawings and the following claims.

DETAILED DESCRIPTION

Figure 1A:
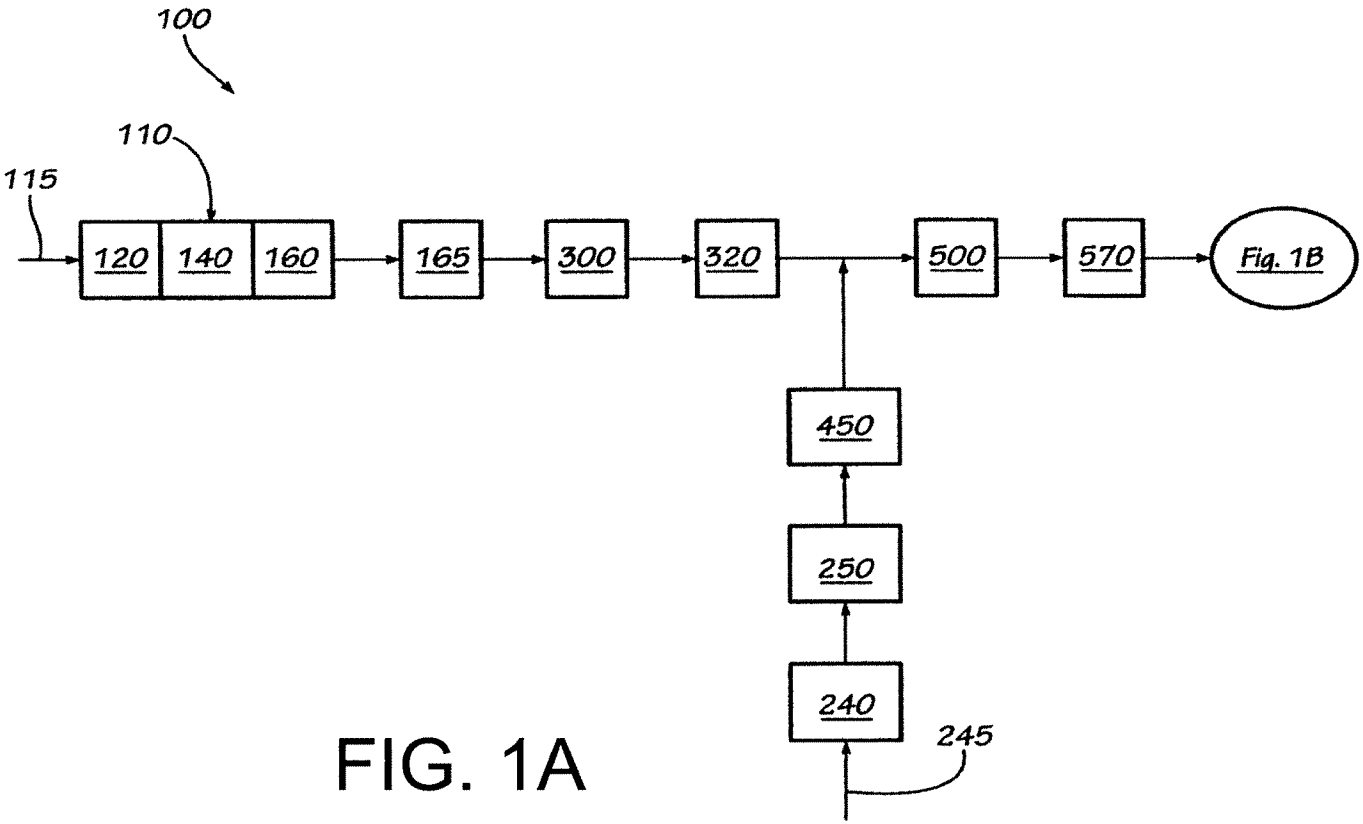
FIG. 1A is a flow chart showing the container filling system as described herein.
Figure 1B:
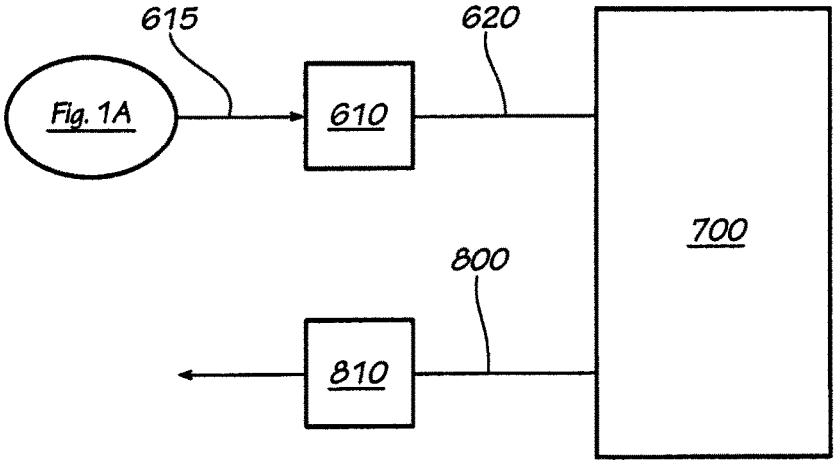
FIG. 1B is a flow chart showing the filling path of the container filling system of FIG. 1A.

Referring now to the drawings, in which like numerals refer to like elements throughout the several views, FIGS. 1A and 1B shows a schematic view of a container filling system 100 as is described herein. The container filling system 100 may include a number of stations or modules with each station or module performing different tasks. The functions of these stations or modules need not necessarily be performed in any particular order. Further, not each station or module may be required herein and alternative stations or modules also may be used herein. The stations or modules may be positioned along one or more predetermined paths within the container filling system 100.

The container filling system 100 may include a pouch station 110 positioned along a first predetermined path 115. The pouch station 110 may include a pouch making assembly 120. The pouch making assembly 120 may cut and join one or more layers of a continuous thermoplastic material via heat sealing or other types of conventional methods so as to form a pouch 130. An example of such a pouch making assembly 120 is manufactured by B&B MAF of Hopsten, Germany and may be sold under the designation of SFB 8E-L-4. Similar types of manufacturing devices may be used herein.

The pouch station 110 further may include a fitment insertion device 140. The fitment insertion device 140 inserts a fitment 150 into the pouch 130 and seals the fitment 150 therein. An example of the fitment insertion device 140 is manufactured by B&B MAF of Hopsten, Germany and may be sold under the designation of SFB 8E-L-4. Similar types of insertion devices may be used herein. The fitment 150 may be made of a thermoplastic or a similar material. The fitment 150 may be any type of one way valve or other type of connector. The fitment 150 may have a direction groove therein to ensure proper alignment during transport.

The pouch station 110 may include a pouch leak detector 160. The pouch leak detector 160 may insert an amount of air into the pouch 130 to ensure that the pouch 130 is properly sealed. An example of a pouch leak detector 160 is manufactured by Wilco of Wohlen, Switzerland and is sold under the designation of R36 OT/P/SPEZ. Similar types of leak detection devices may be used herein.

Figure 2:
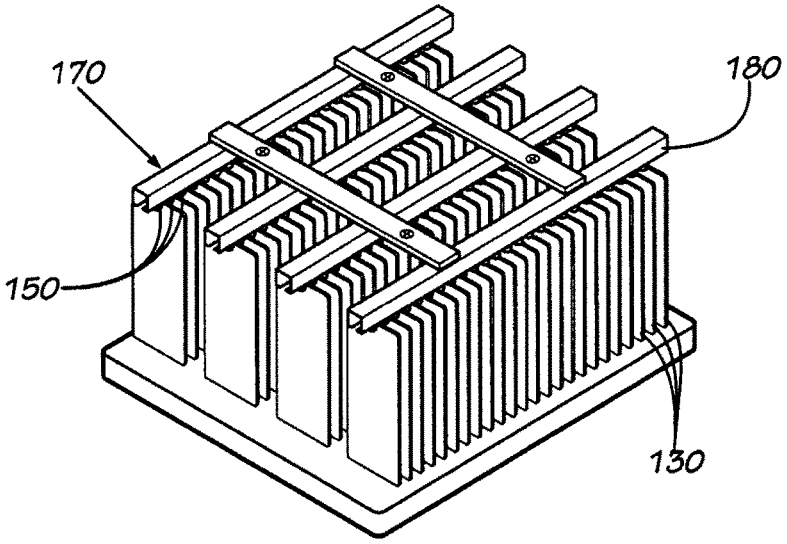
FIG. 2 is a perspective view of a pouch rail as may be used in the container filling system of FIG. 1A.

The use of the pouch making assembly 120 is optional. Alternatively, the pouches 130 may be manufactured elsewhere and delivered to the container filling system 100. In either case, the individual pouches 130 may be maneuvered via a pouch transport system 165. The pouch transport system 165 may use a number of pouch rails 170 for transport. As is shown in FIG. 2, each pouch rail 170 may include a number of elevated C-rails 180. The pouches 130 may be held by the fitments 150 within the C-rails 180. The pouches 130 then may be transported upon the pouch rail 170 as desired. Other types of transport means may be used herein.

Figure 3:
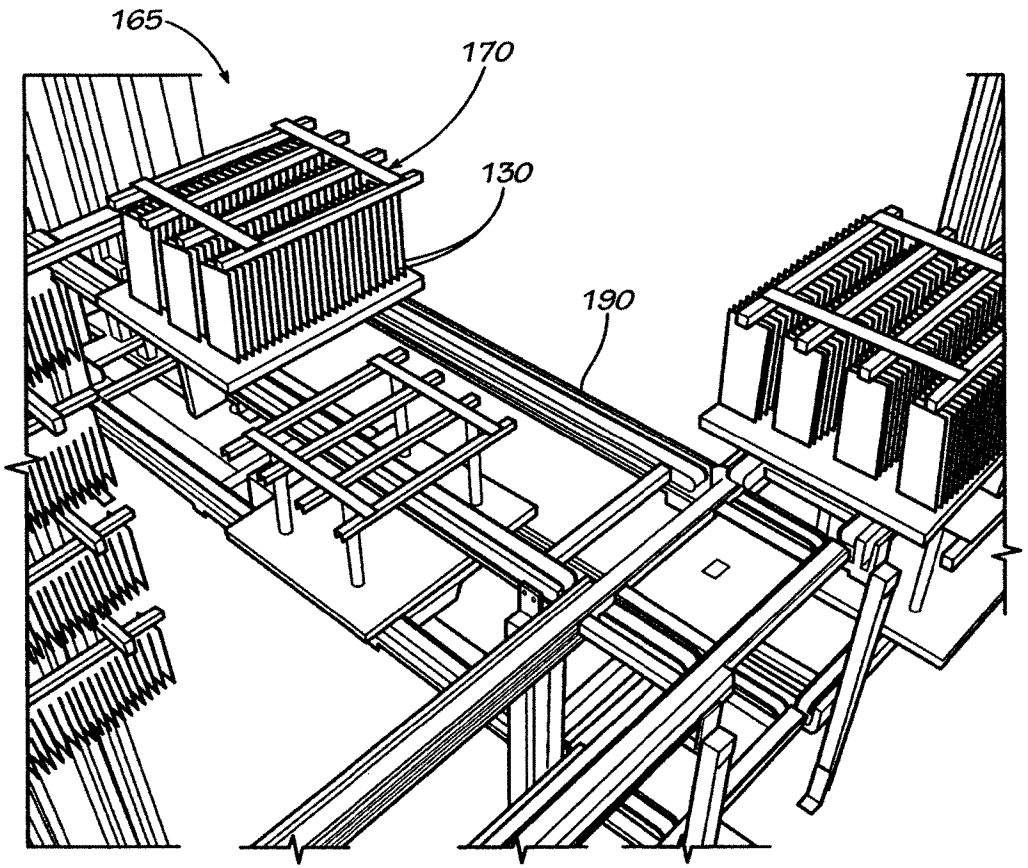
FIG. 3 is a perspective view of a horizontal conveyor as may be used in the container filling system of FIG. 1A.
Figure 4:
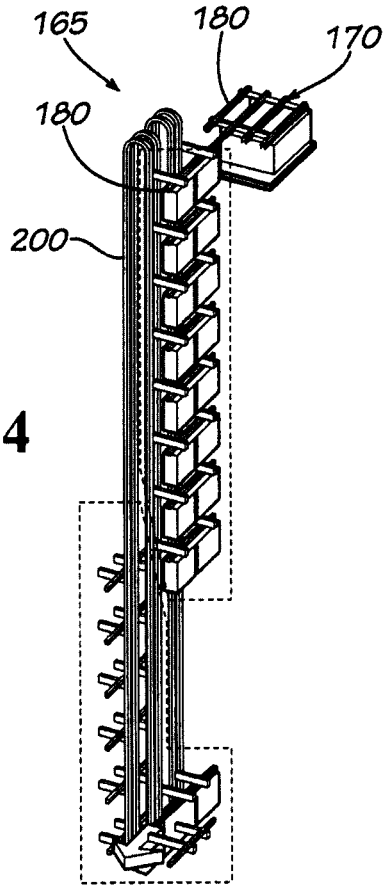
FIG. 4 is a perspective view of a vertical conveyor as may be used in the container filling system of FIG. 1A.

As is shown in FIG. 3, the pouch transport system 165 may include a number of horizontal conveyors 190 in which the entire pouch rail 170 is transported in any horizontal direction. An example of the horizontal conveyor 190 is manufactured by OPM of Monticello d'Alba, Italy and sold under the designation TP-B. Further, the individual pouches 130 may be pushed off of the C-rails 180 of the pouch rail 170 and onto a C-rail 180 on a vertical conveyor 200 as is shown in FIG. 4. An example of the vertical conveyor 200 is manufactured by OPM of Monticello d'Alba, Italy and sold under the designation E-B. In this manner, the pouches 130 may be transported in either a horizontal or a vertical direction as desired. One or more further horizontal conveyors 195 also may transport the pouches 130 downstream of the vertical conveyor 200 via the fitments 150 or otherwise. Any combination of horizontal conveyors 190, 195 and vertical conveyors 200 may be used herein. Other types of transport means also may be used herein.

Figure 5:
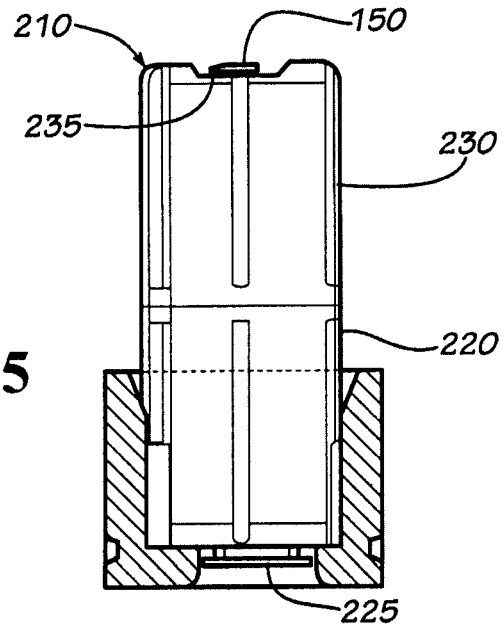
FIG. 5 is a perspective view of a cartridge as may be used in the container filling system of FIG. 1A.

While the pouches 130 are being manufactured and/or transported, a number of cartridges 210 also may be manufactured. As is shown in FIG. 5, the cartridges 210 each may have a bottom half 220 and a top half 230. The cartridges 210 may have any desired size, shape, and configuration. The cartridges 210 also may have a handle 225 on the bottom half 220 thereof. Likewise, the top half 230 may have a fitment aperture 235 therein. The cartridges 210 may be made of a thermoplastic material or any type of somewhat rigid material. The cartridges 210 may be manufactured within the container filling system 100 or manufactured separately and delivered thereto.

The container filling system 100 may include a cartridge assembly 240 positioned along a second predetermined path 245. The cartridge assembly 240 may be an injection molder or other type of plastics manufacturing device. An example of the cartridge assembly 240 is manufactured by GIMA of Bologna, Italy and sold under the designations M-163 and M-156. Other types of cartridge manufacturing devices may be used herein.

Figure 6:
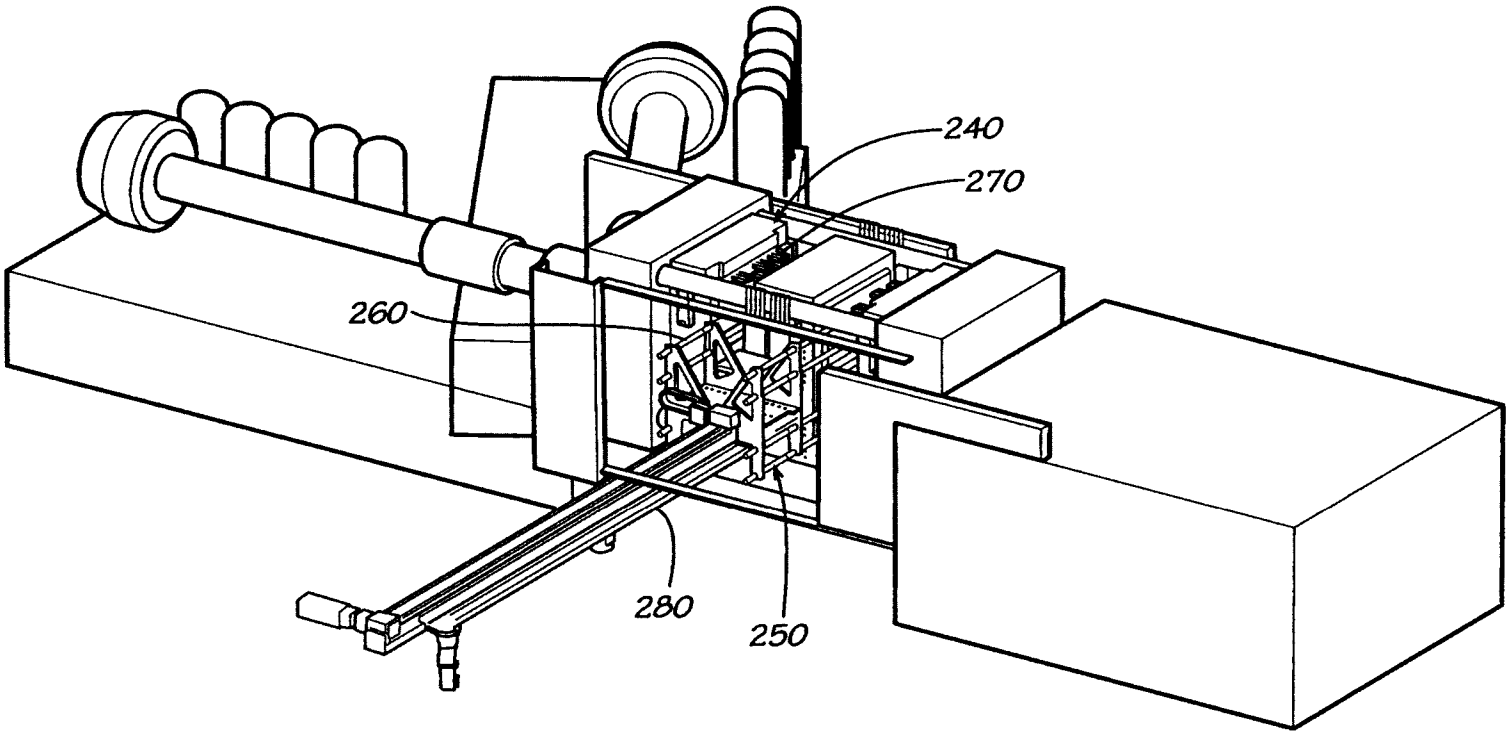
FIG. 6 is a perspective view of a cartridge assembly as may be used in the container filling system of FIG. 1A.

As is shown in FIG. 6, the molded cartridges 210 may be removed from the cartridge assembly 240 via a picking assembly 250. The picking assembly 250 may have a number of elongated arms 260 with a number of cartridge pocket nests 270. The cartridge pocket nests 270 may be positioned about each cartridge half 220, 230 and extract the halves 220, 230 from the cartridge assembly 240 via suction or similar methods. The picking assembly 250 may maneuver along an elongated beam 280. Other types of maneuvering devices may be used herein.

Figure 7:
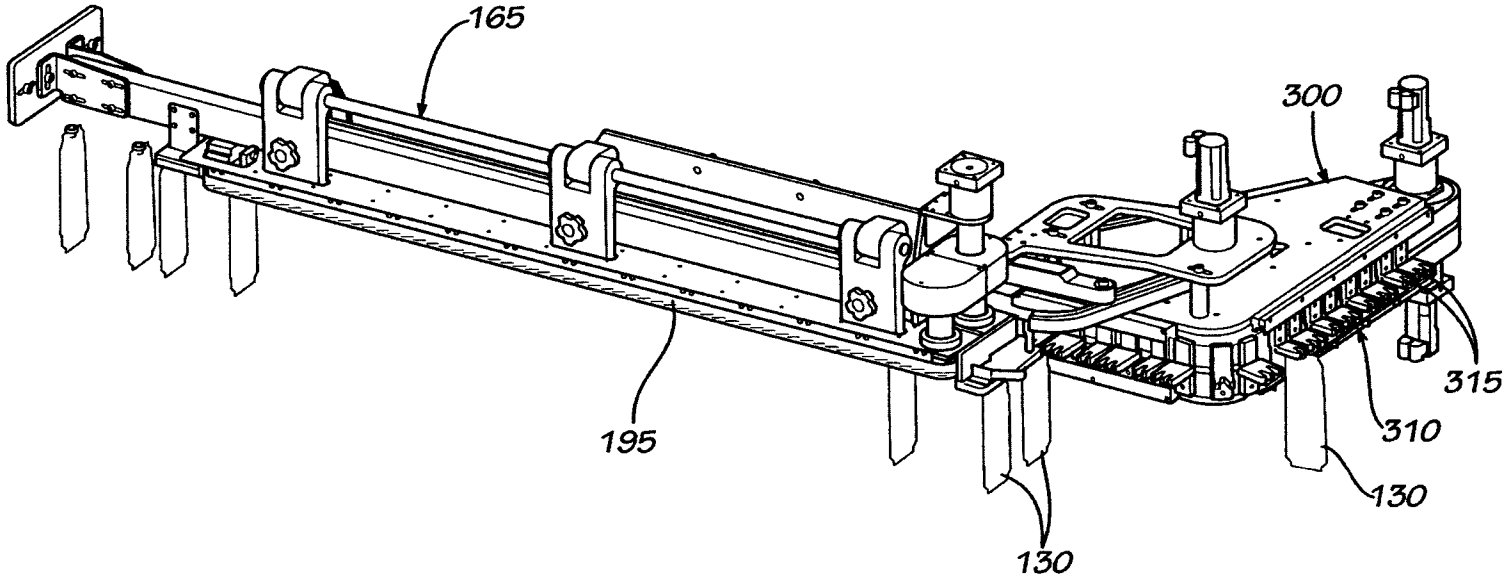
FIG. 7 is a perspective view of a pouch loading assembly as may be used in the container filling system of FIG. 1A.

The container filling system 100 may include a pouch loading assembly 300 positioned along the first predetermined path 115. As is shown in FIG. 7, the pouch loading assembly 300 may be in communication with one of the further horizontal conveyors 195 of the pouch transport system 165 or another source of the pouches 130. The pouch loading assembly 300 may include a pouch loading racetrack 310 that removes each pouch 130 from the pouch transport system 165 or other source and aligns a number of the pouches 130 in a group. An example of the pouch loading racetrack 310 is manufactured by GIMA of Bologna, Italy and sold under the designations M-163 and M-156. The racetrack 310 may hold the pouches 130 via the fitments 150 via a number of gripper fingers 315 or the like. Other types of transfer devices may be used herein.

Figure 8:
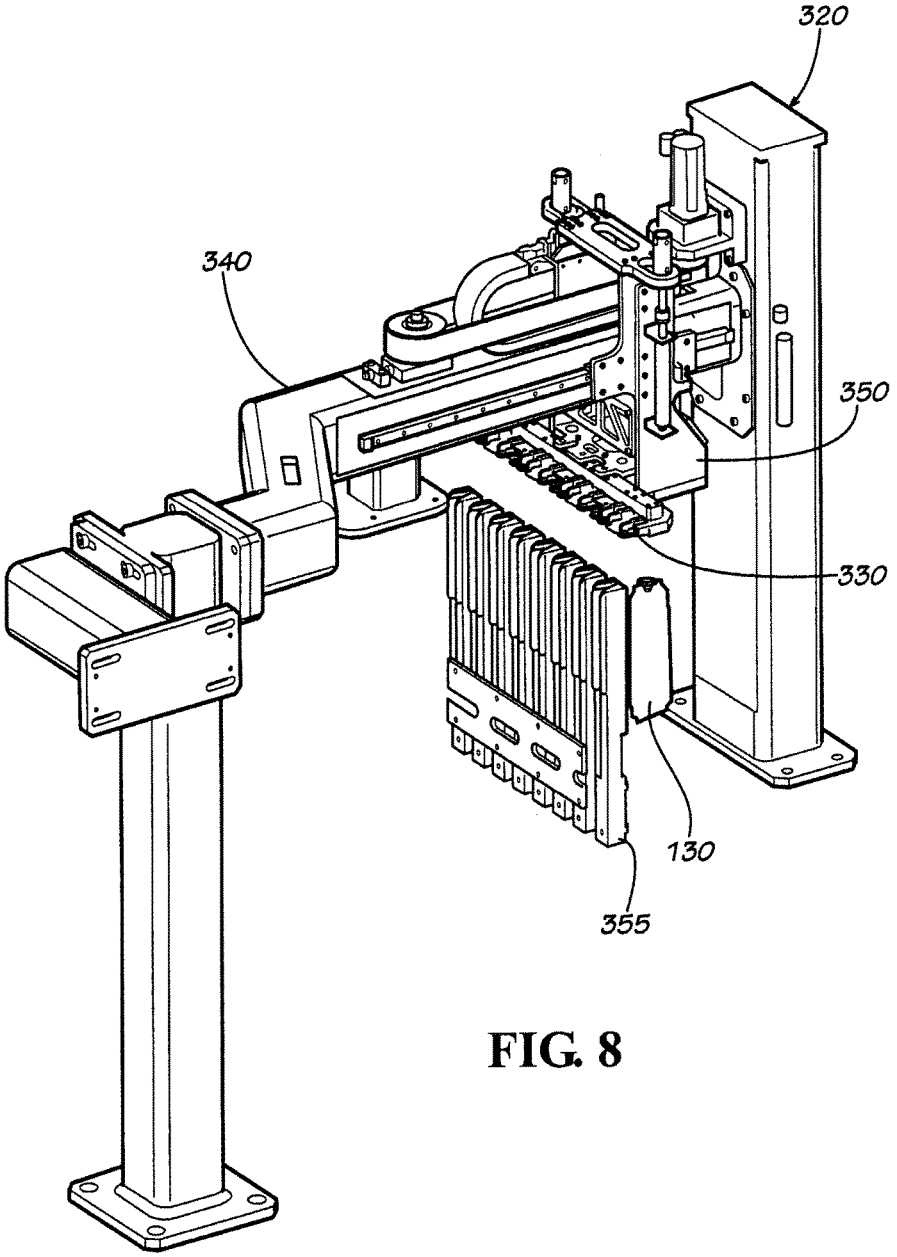
FIG. 8 is a perspective view of a pouch transfer assembly as may be used in the container filling system of FIG. 1A.

A pouch transfer assembly 320 may be positioned adjacent to the pouch loading racetrack 310 along the predetermined path 115. As is shown in FIG. 8, the pouch transfer assembly 320 may include a number of fingers 330 or other type of grabbing device. The pouch transfer assembly 320 may include a horizontal beam 340 and one or more vertical beams 350 for movement therewith. The fingers 340 may grab a number of the pouches 130 from the pouch loading racetrack 310 and position them via movement along the horizontal beam 340 and the vertical beam 350 as will be described in more detail below. A pouch guide 355 also may be used to position the pouches 130. An example of the pouch transfer assembly 320 is manufactured by GIMA of Bologna, Italy and sold under the designations M-163 and M-156. Other types of transfer devices may be used herein.

Figure 9:
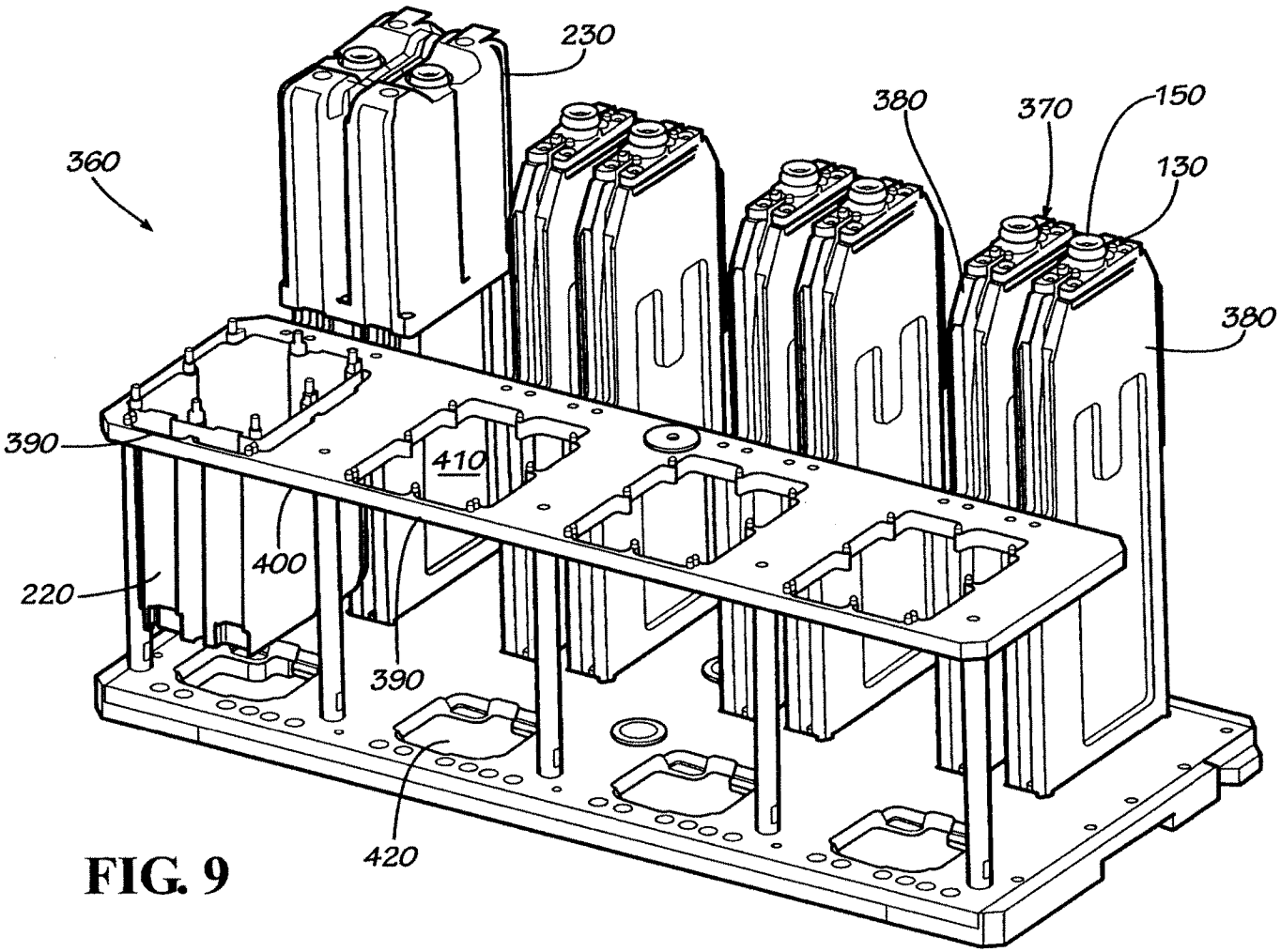
FIG. 9 is a perspective view of a pouch and cartridge pallet as may be used in the container filling system of FIG. 1A.

The pouch transfer assembly 320 may cooperate with a number of pouch and cartridge pallets 360. As is shown in FIG. 9, each pouch and cartridge pallet 360 may include a number of pouch supports 370. The pouch supports 370 may include a pair of arms 380 with an amount of space therebetween. The arms 380 are sized so as to permit a pouch 130 be positioned therein and supported by the fitment 150. The pouch and cartridge 360 also includes a bottom cartridge support 390. The bottom cartridge support 390 may include an elevated frame 400 with a number of apertures 410 formed therein. The frame 400 and the apertures 410 are sized so as to permit the bottom half 220 of the cartridges 210 to be positioned therein. The bottom cartridge support 390 also may have a handle aperture 420 formed therein such that a handle 225 may be attached to the bottom half 220. The bottom cartridge support 390 may vary in size depending upon the size of the cartridge 210 to be used therein. For example, a cartridge 210 that is sized to include two pouches 130 would be double the size of a cartridge 210 intended to be filled with only one pouch 130.

As described above, the pouch transfer assembly 320 may grab a number of the pouches 130 from the pouch loading racetrack 310. The pouch transfer assembly 320 may then slide each pouch 130 into one of the pouch supports 370 of the pouch and cartridge pallet 360. Other types of transfer devices and methods may be used herein.

Figure 10:
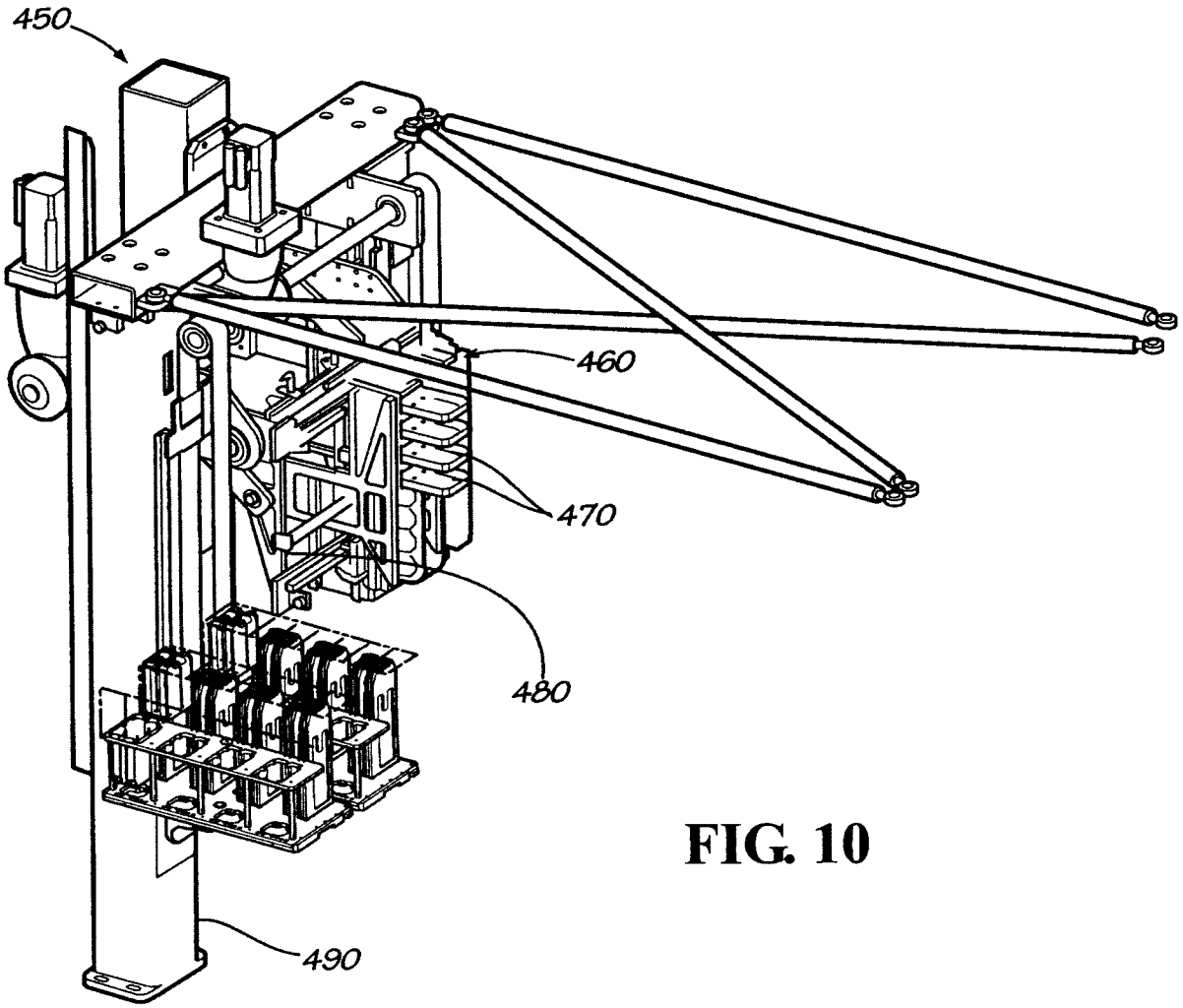
FIG. 10 is a perspective view of a cartridge takeoff device as may be used in the container filling system of FIG. 1A.

101491 The container filling system 100 further may include a cartridge takeoff station 450. The cartridge takeoff station 450 may be positioned about the second predetermined path 245 near the picking assembly 250 and near the first predetermined path 115. As is shown in FIG. 10, the cartridge takeoff station 450 may include a number of cartridge takeoff devices 460. The cartridge takeoff device 460 may include a number of inserts 470. The inserts 470 may be positioned about a rotatable base 480. The rotatable base 480 may be positioned within a frame 490 for vertical motion therewith. An example of the cartridge takeoff device 460 is sold by GIMA of Bologna, Italy and sold under the designations M-163 and M-156. Other types of grabbing devices may be used herein.

The inserts 470 of the cartridge takeoff device 460 may be positioned within the halves 220, 230 of the cartridges 210. The cartridge takeoff device 460 removes the halves 220, 230 from the picking assembly 250 and then rotates downward so as to place the halves 220, 230 within a pouch and crate pallet 360 advancing along the first predetermined path 115. As is described above, the bottom half 220 is positioned within the bottom cartridge support 390 while the top half 230 is positioned on the pouch 130 within the pouch support 370. The fitment 150 is pushed through the fitment aperture 235 of the top half 230 and is secured therewith.

Figure 11:
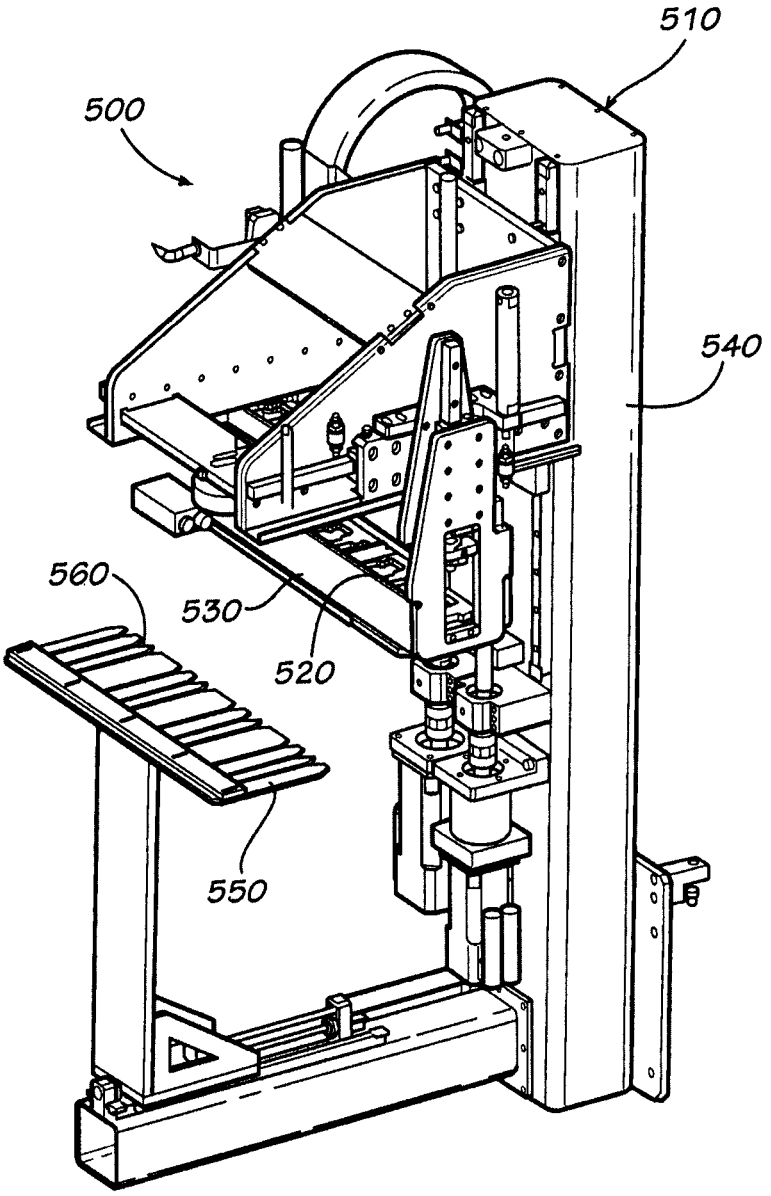
FIG. 11 is a perspective view of a cartridge assembly device as may be used in the container filling system of FIG. 1A.
Figure 12:
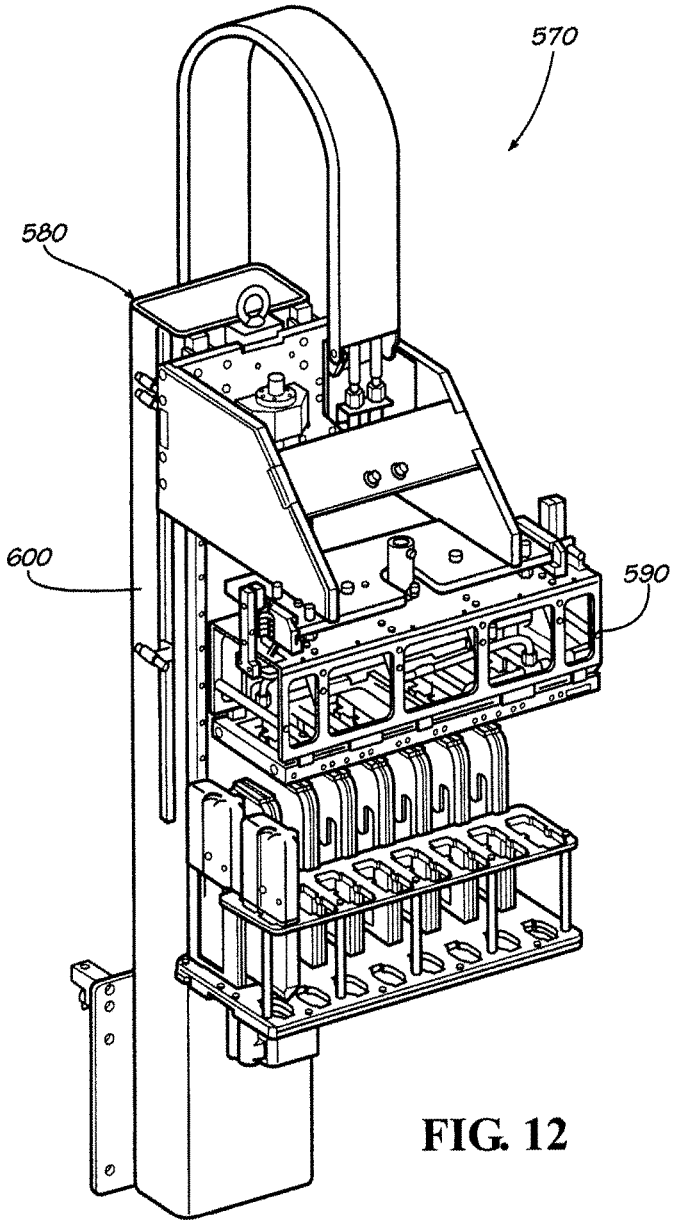
FIG. 12 is a perspective view of a heat stake assembly as may be used in the container filling system of FIG. 1A.

The container filling system 100 further includes a cartridge completion station 500 positioned about the predetermined path 115. As is shown in FIG. 11, the cartridge completion station 500 may include a cartridge assembly device 510. The cartridge assembly device 510 may include a number of fingers 520 positioned within a moveable plate 530. The plate 530 may be positioned within a frame 540 for both vertical and horizontal motion. The cartridge assembly device 510 further may include a pouch guide 550. The pouch guide 550 also may include a number of slots 560 so as to position the pouch 130 therethrough. Specifically, the fingers 520 of the plate 530 may grab the top half 230 of the cartridge 210 and maneuver the top half 230 onto the bottom half 220 via the pouch guide 550. An example of the cartridge assembly device 510 is manufactured by GIMA of Bologna, Italy and sold under the designations M-163 and M-156. Other types of positioning devices may be used herein.

The container filling system 100 further may include a heat stake station 570 positioned about the predetermined path 115. As is shown in FIG. 11, the heat stake station 570 may include a heat stake assembly 580. The heat stake assembly 580 may include a heated plate 590 attached to a frame 600 for vertical motion therewith. The heated plate 590 may lowered into place about the cartridges 210 so as to apply heat to seal the bottom half 220 and the upper half 230 together. Other types of sealing means may be used herein. An example of the heat stake assembly 580 is sold by GIMA of Bologna, Italy and sold under the designations M-163 and M-156.

The container filling system 100 also may include other stations such as a handle attachment station and the like. Other stations and arrangements also may be used herein. The completed cartridges 210 may be stored or immediately filled as is described in more detail below.

Figure 13:
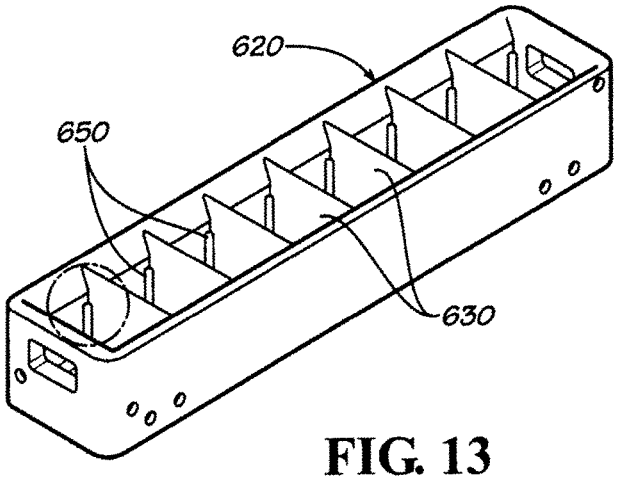
FIG. 13 is a perspective view of a puck as may be used in the container filling system of FIG. 1B.
Figure 14:
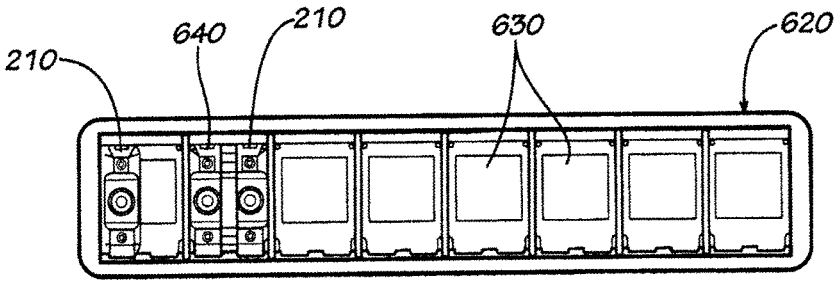
FIG. 14 is a top plan view of the puck of FIG. 12.
Figure 15:
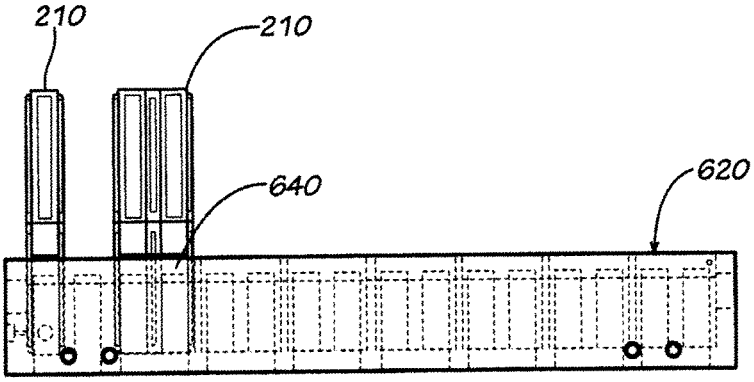
FIG. 15 is a side plan view of the puck of FIG. 12.

The container filling system 100 also may include a puck loading station 610 positioned along a predetermined filling path 615. The puck loading station 610 may load a number of the cartridges 210 into a puck 620 for further transport as will be described in more detail below. As is shown in FIGS. 13-15, each puck 620 may include a number of pockets 630 positioned therein. The puck 620 and the pocket 630 may have any desired size or shape. Specifically, the pockets 630 may be sized for one or more of the cartridges 210 to be positioned therein in a correct orientation. In the case of a single pouch cartridge 210, two of the cartridges 210 may be positioned therein. The cartridges 210 may have a number of recesses 640 that match a number of bosses 650 on the puck 620 to ensure the correct orientation. The positioning of the recesses 640 and the bosses 650 may be reversed. Other types of orientation means may be used herein. The puck 620 may be made from substantially rigid thermoplastics or other types of substantially rigid materials.

Figure 16:
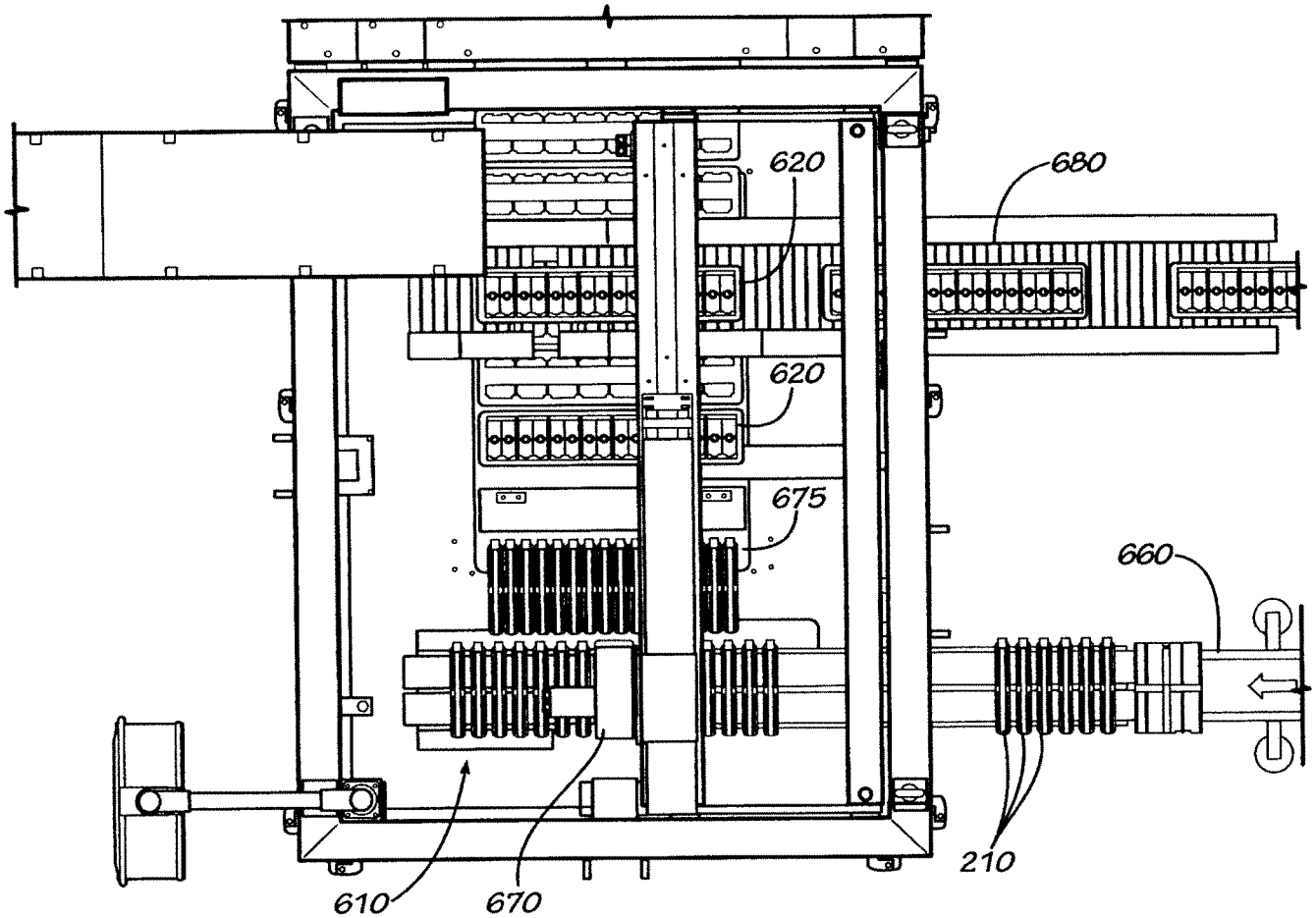
FIG. 16 is a top plan view of a puck loading station as may be used in the container filling system of FIG. 1B.

The completed cartridges 210 may advance to the puck loading station 610 via an in-feed conveyor 660 along the predetermined filling path 615. As is shown in FIG. 16, a number of the cartridges 210 then may be pushed into a horizontal puck 620 via a push arm 670. The puck 620 then may be rotated to a vertical position via a rotating plate 675 and then pushed further onto an out-feed conveyor 680. Other types of loading mechanisms may be used herein.

Figure 17:
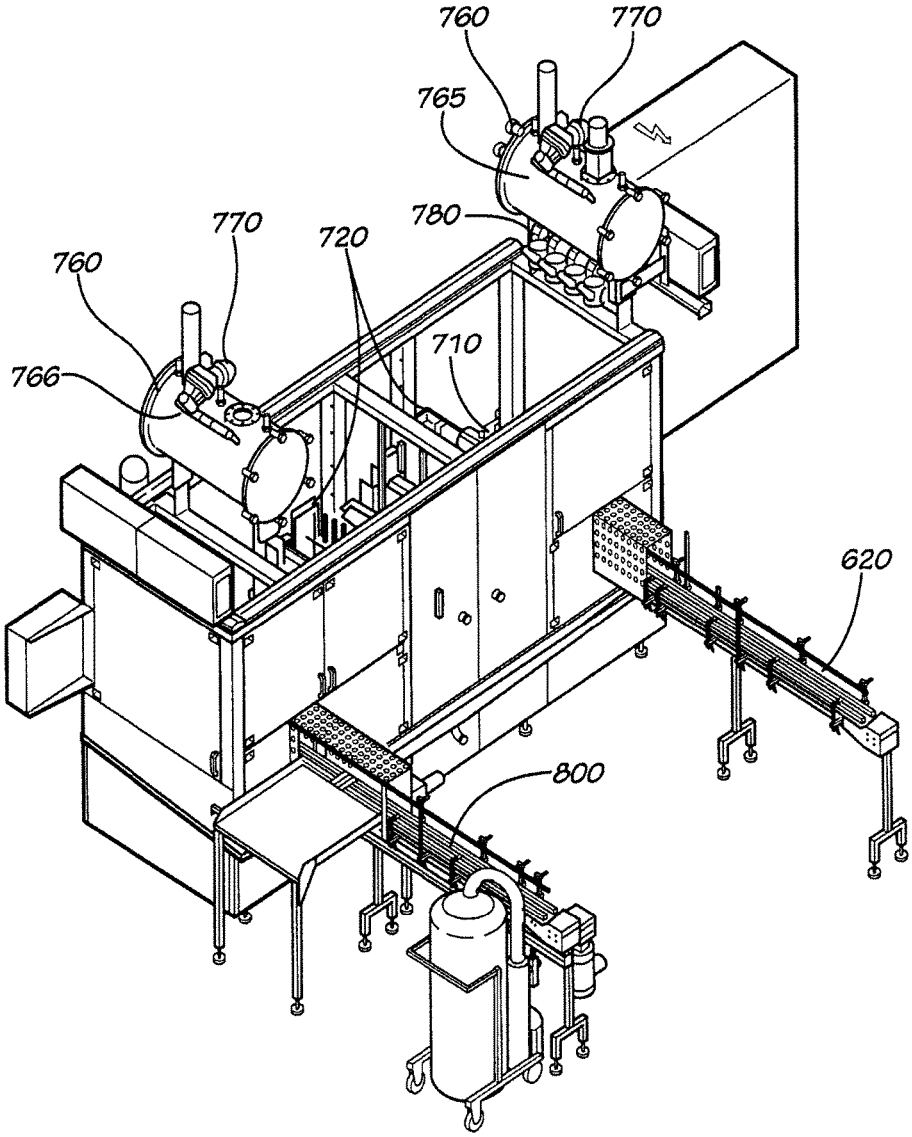
FIG. 17 is a perspective view of a filling station as may be used in the container filling system of FIG. 1B.
Figure 18:
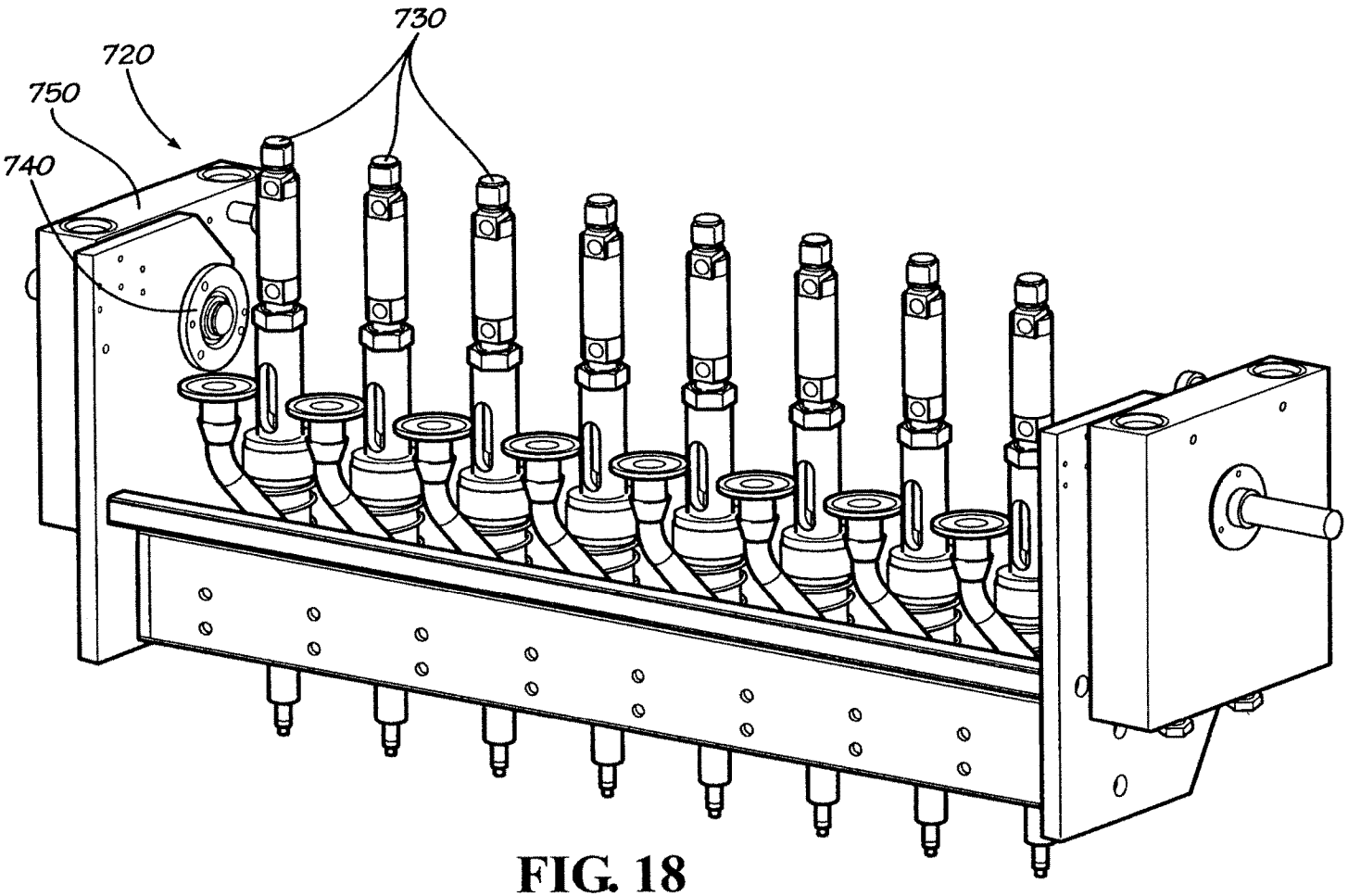
FIG. 18 is a perspective view a filling unit as may be used in the filling station of FIG. 17.

The container filling system 100 also may include a filling station 700 positioned along the predetermined filling path 615. The filling station 700 may be in communication with the out-feed conveyor 680. As is shown in FIGS. 17 and 18, the filling station 700 may include a puck transport conveyor 710. Other types of maneuvering mechanisms may be used herein.

A number of filling units 720 may be positioned about the puck transport conveyor 710. Any number of filling units 720 may be used. The filling units 720 may have a number of filling nozzles 730. The filling nozzles 730 may be maneuverable in the vertical direction via a cam 740 and a cam support 750. Other types of maneuvering devices may be used herein. Each of the filling nozzles 730 may be in communication with a product tank 760 with a product 765, 766 therein. The products 755, 756 may be the same or different. The product tanks 760 may have any desired dimension or volume. Each product tank 760 may have an agitation device 770 therein to keep the product from stratifying. A flow meter 780 may be positioned between the product tank 760 and each filling nozzle 730. Other types of flow control devices may be used herein. An example of a filling unit 720 is sold by S.F. Vision GmbH of Schwäbisch Hall, Germany under the designation "MDM". Other types of filling devices may be used herein.

In the case of a dual pouch cartridge 210, the first pouch 130 may be filled with a first product 765 in a first filling unit 720. The puck 620 may continue down the puck transport conveyor 710 to a second filling unit 720 where a second product 766 may be filled therein. The filling nozzle 730 fits within the fitment 150 of each cartridge 210. Likewise, with respect to single pouch cartridge 210, the first filling unit 720 may fill every other cartridge 210 and the second filling unit 720 may fill the remaining cartridges 210. A cleaning station may be positioned about the puck transport conveyor 710 so as to remove any residue of product on each cartridge 210. Other filling methods may be used herein. An outfeed conveyor 800 may be used to transport the filled cartridges 210 away from the filling station 700.

The container filling system 100 further may include a puck unloading station 810. The puck unloading station 810 may be similar to the puck loading station 610. The pucks 620 may be rotated into a horizontal position and the cartridges 210 may be removed therefrom. The cartridges 810 may then be transported for further processing including weighing, labeling, packing, etc.

As described above, the product 765, 766 preferably may be micro-ingredients, i.e., reconstitution ratios of about ten to one or higher. A beverage dispenser thus may have any number of cartridges 210 having many different products 765, 766 therein so as to produce a large number of different beverages in a relatively small footprint.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

I claim:

1. A system for filling pouches, comprising:

a puck for loading the pouches therein;

a conveyor for maneuvering the puck along a predetermined path;

a first filling tank adapted to hold a first product;

a first filling unit in communication with the first filling tank, the first filling unit positioned along the predetermined path and adapted to fill a first number of the pouches in the puck with the first product;

a second filling tank adapted to hold a second product; and a second filling unit in communication with the second filling tank, the second filling unit positioned along the predetermined path for filling a second number of the pouches in the puck with the second product;

wherein the puck comprises a plurality of pockets.

2. A system for filling pouches, comprising:

a puck for loading the pouches therein;

a conveyor for maneuvering the puck along a predetermined path;

a first filling tank adapted to hold a first product;

a first filling unit in communication with the first filling tank, the first filling unit positioned along the predetermined path and adapted to fill a first number of the pouches in the puck with the first product;

a second filling tank adapted to hold a second product; and a second filling unit in communication with the second filling tank, the second filling unit positioned along the predetermined path for filling a second number of the pouches in the puck with the second product.

3. The system of claim 2, wherein the first filling unit is adapted to fill every other pouch in the puck and the second filling unit is adapted to fill the remaining pouches in the puck.

4. The system of claim 2, wherein the first product is the same as the second product.

5. The system of claim 2, wherein the conveyor comprises a push arm and a rotating plate.

6. The system of claim 2, wherein the conveyor comprises an in-feed conveyor, a puck transport conveyor, and an out-conveyor.

7. The system of claim 2, wherein the first filling unit comprises a first filling nozzle.

8. The system of claim 7, wherein the first filling unit comprises a cam to maneuver the first filling nozzle.

9. The system of claim 7, wherein the first number of pouches comprises a first fitment thereon sized to accommodate the first filling nozzle.

10. The system of claim 2, wherein the second filling unit comprises a second filling nozzle.

11. The system of claim 10, wherein the second number of pouches comprises a second fitment thereon sized to accommodate the second filling nozzle.

12. The system of claim 2, wherein the first filling tank comprises an agitation device therein.

13. The system of claim 2, wherein the first filling unit comprises a flow meter.

14. The system of claim 2, further comprising a cleaning station positioned along the conveyor.

15. The system of claim 2, wherein the first product comprises a micro-ingredient.

16. The system of claim 15, wherein the micro-ingredient comprises a reconstitution ratio of about ten to one or higher.

17. The system of claim 15, wherein the micro-ingredient comprises a reconstitution ratio of about fifty to one or higher.

18. A method for filling pouches, comprising:

loading the pouches into a puck;

maneuvering the puck along a predetermined path;

filling a first number of the pouches in the puck with a first product at a first filling unit positioned along the predetermined path; and filling a second number of the pouches in the puck with a second product at a second filling unit positioned along the predetermined path.

19. The method of claim 18, wherein the step of filling a first number of the pouches in the puck with a first product comprises filling every other pouch in the puck.

20. The method of claim 19, wherein the step of filling a second number of the pouches in the puck with a second product comprises filling the remaining pouches in the puck.

* * * * *